US008921721B2

(12) United States Patent
Senzaki et al.

(10) Patent No.: US 8,921,721 B2
(45) Date of Patent: Dec. 30, 2014

(54) SWITCH DEVICE

(75) Inventors: Daisuke Senzaki, Aichi (JP); Hiromitsu Mizuno, Aichi (JP); Shinichi Koga, Aichi (JP); Kota Nishida, Aichi (JP); Shinya Hattori, Aichi (JP); Katsuharu Tachibana, Nagoya (JP); Akira Ogino, Toyota (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 358 days.

(21) Appl. No.: 13/290,756

(22) Filed: Nov. 7, 2011

(65) Prior Publication Data

US 2012/0111709 A1 May 10, 2012

(30) Foreign Application Priority Data

Nov. 9, 2010 (JP) ..... 2010-250860

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/85*** | (2006.01) |
| ***G07C 9/00*** | (2006.01) |
| ***H01H 9/02*** | (2006.01) |
| ***H01H 13/86*** | (2006.01) |
| ***G05G 1/02*** | (2006.01) |
| *H01H 11/00* | (2006.01) |

(52) U.S. Cl.

CPC ..... *H01H 13/85* (2013.01); *G07C 9/00944* (2013.01); *H01H 9/0235* (2013.01); *H01H 13/86* (2013.01); *G05G 1/02* (2013.01); *H01H 2011/0087* (2013.01); *H01H 2215/00* (2013.01); *H01H 2221/03* (2013.01); *H01H 2221/058* (2013.01); *H01H 2223/003* (2013.01); *H01H 2227/032* (2013.01); *H01H 2229/02* (2013.01); *H01H 2229/046* (2013.01); *H01H 2231/032* (2013.01)

USPC ..... 200/5 A; 200/512

(58) Field of Classification Search

USPC ..... 200/516, 512

See application file for complete search history.

(56) References Cited

U.S. PATENT DOCUMENTS 4,323,740 A * 4/1982 Balash ..... 200/5 A (Continued)

FOREIGN PATENT DOCUMENTS

| | | | |
|---|---|---|---|
| CN | 201289805 | Y | 8/2009 |
| CN | 201298476 | Y | 8/2009 |
| JP | 59-074636 | U | 5/1984 |
| JP | 04-121626 | U | 10/1992 |

(Continued)

*Primary Examiner* — Renee Luebke
*Assistant Examiner* — Lheiren Mae A Caroc
(74) *Attorney, Agent, or Firm* — James R. Gourley; Carstens & Cahoon, LLP

(57) ABSTRACT

A switch device includes a lid arranged between a tactile switch, which is arranged on a substrate, and an operation button, which is coupled to a retainer so that the operation button can be pushed. The lid includes an opening at a location corresponding to the tactile switch. A lower surface of the elastic member is coupled to a surface of the lid. The operation button, when pushed, activates the tactile switch with an elastic member. The operation body, when released from the pushed state, deactivates the tactile switch as a reaction force of the elastic member returns the operation button to an initial position. The switch device includes a projection that supports the operation button. The projection is formed on an upper surface of the elastic member at a location corresponding to the surface of the lid.

11 Claims, 7 Drawing Sheets

(56) References Cited

U.S. PATENT DOCUMENTS

| | | | | |
|---|---|---|---|---|
| 4,892,988 | A * | 1/1990 | Ishii | 200/516 |
| 2008/0135393 | A1 | 6/2008 | Sugimoto | |
| 2009/0020402 | A1 | 1/2009 | Ichikawa et al. | |
| 2009/0277766 | A1 | 11/2009 | Fujitsuna | |

FOREIGN PATENT DOCUMENTS

| | | | |
|---|---|---|---|
| JP | 2002-014735 | A | 1/2002 |
| JP | 2002-231091 | A | 8/2002 |
| JP | 2008-181791 | | 7/2008 |
| JP | 2009-016086 | A | 1/2009 |

* cited by examiner

SWITCH DEVICE

BACKGROUND OF THE INVENTION

The present invention relates to a switch device including a switch member that is activated when pushed.

In the prior art, a remote controller that remotely operates a controlled subject, such as a vehicle door, includes a switch device that switches the state of a switch contact when pushed. In particular, an electronic key such as a remote control key includes a push-type switch device that activates a contact when a button is pushed (refer to, for example, Japanese Laid-Open Patent Publication No. 2008-181791).

Referring to FIG. 14, the switch device described in Japanese Laid-Open Patent Publication No. 2008-181791 includes a substrate 53 and a switch member 54 (switch contact) arranged on the substrate 53. A rubber sheet 55, for example, is arranged on the switch member 54. A button 52, which can be pushed, is arranged in an opening 51 of a case 50. In the switch device, the button 52 is supported at only one location, which is the central part of the rubber sheet 55 (one-point support structure).

A pushing element 56 projects downward from the lower surface of the button 52 and contacts the rubber sheet 55.

In the switch device that has the one-point support structure described above, when the button 52 is pushed, the button 52 may incline or sway about the pushing element 56. This results in uncomfortable pushing of the button 52 and is thus undesirable. Further, when the button 52 is pushed, as the pushing force increases, the reaction force acting against the pushing force does not initially increase as much as the pushing force. Thus, the initial pushing force and the movement of the button 52 are not in a linear relationship. As the pushing force is further increased by a certain amount and the reaction force becomes large, the central part of the rubber sheet 55 finally starts to move downward. Thus, the operation feel of the button 52 is not constant, which is undesirable. The same problem related to the operation feel also occurs when the button 52 does not have the pushing element 56, and part of a resin member supports the lower surface of the button 52 instead.

SUMMARY OF THE INVENTION

One aspect of the present invention is a switch device including an immovable member, and elastic member, and a projection. The immovable member is arranged between a switch member, which is arranged on a substrate, and an operation body. The operation body is coupled to a housing so that the operation body can be pushed. The immovable member includes an opening formed at a location corresponding to the switch member. The elastic member includes a first surface, which is coupled to a surface of the immovable member, and an opposite second surface. The operation body, when pushed, activates the switch member with the elastic member. Further, the operation body, when released from the pushed state, deactivates the switch member as a reaction force of the elastic member returns the operation body to an initial position. The projection supports the operation body. The projection is formed on the second surface of the elastic member at a location corresponding to the surface of the immovable member.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE INVENTION

A switch device according to one embodiment of the present invention will now be described with reference to the drawings. For example, the switch device may be arranged in an operation unit of a remote control key used in an electronic key system for a vehicle.

Figure 1:
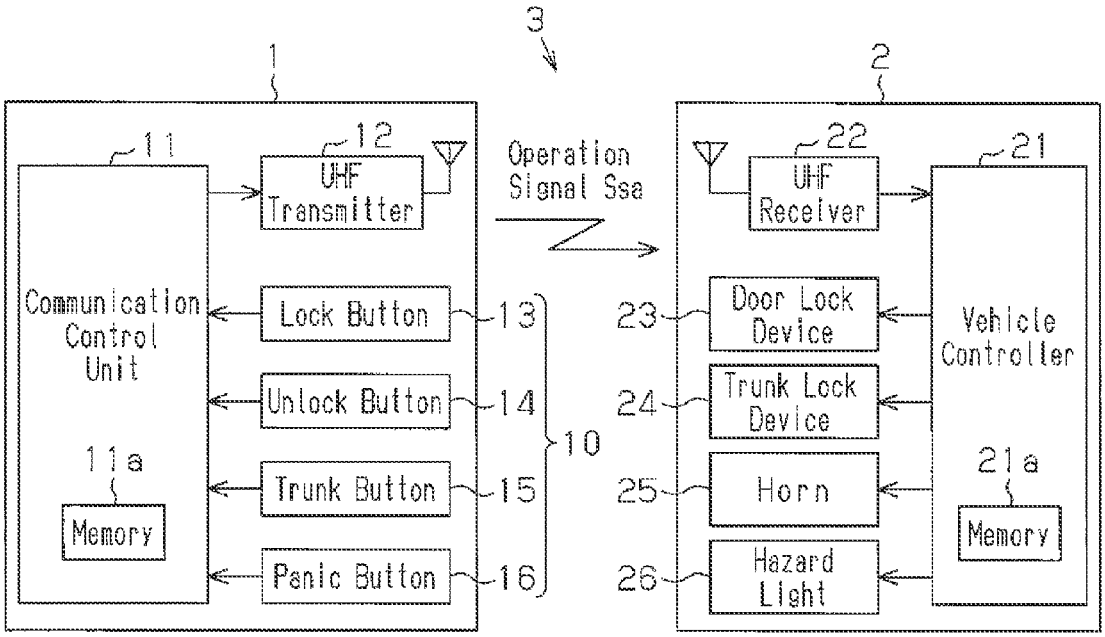
FIG. 1 is a block diagram of an electronic key system.

Referring to FIG. 1, a remote control key 1 used in a wireless key system 3 transmits an operation signal Ssa through wireless communication to a vehicle 2 when a button is operated. The operation signal Ssa is used to lock or unlock the doors of a vehicle 2. In the present embodiment, the remote control key 1 is a mechanical key including a grip and a key plate. A plurality of operation buttons 10 are arranged on the grip. The operation signal Ssa of the remote control key 1 can be used to instruct, for example, the locking or unlocking of the doors, the unlocking of the trunk, and the generation of noise and light to intimidate an assailant.

The remote control key 1 includes a communication control unit 11. The communication control unit 11 includes a memory 11*a*. An ID code, which is a key code unique to the remote control key 1, is registered to the memory 11*a*. A UHF transmitter 12, which is connected to the communication control unit 11, transmits a radio wave on the ultrahigh frequency (UHF) band (approximately 312 MHz).

The remote control key 1 includes at least one operation button 10 (push button) that is connected to the communication control unit 11. In the illustrated example, the operation buttons 10 include a lock button 13, which is operated to lock the doors of the vehicle 2, an unlock button 14, which is operated to unlock the doors of the vehicle 2, a trunk button 15, which is operated to unlock the trunk of the vehicle, and a panic button 16, which is operated to generate noise (sound) and light in order to intimidate an assailant. The UHF transmitter 12 modulates communication data, which is provided from the communication control unit 11, and transmits the UHF band signal Ssa, which includes the unique ID code of the remote control key 1, and operation information.

The wireless key system 3 includes a controller 21 arranged in the vehicle 2. A UHF receiver 22, which is capable of receiving a wireless signal in the UHF band, is connected to the controller 21 and, for example, embedded in the vehicle body. The controller 21 is connected to a door lock device 23, which locks and unlocks the doors, a trunk lock device 24, which locks and unlocks the trunk, a horn 25, which generates warning noise, and a hazard light 26. The controller 21 includes a memory 21*a*. An ID code is registered to the memory 21*a*. The controller 21 verifies the ID code included in a wireless signal received from the remote control key 1 with the ID code registered in the memory 21*a* (ID verification). The hazard light 26 also functions as turn signals. Thus, operation of the hazard light 26 flashes each turn signal.

In the description hereafter, a short push operation refers to the pushing of an operation button 10 for a relatively short time that is less than a reference period. Further, a long push operation refers to the pushing of an operation button 10 for a relatively long time that is greater than or equal to the reference period.

When the lock button 13 undergoes a short push operation, the communication control unit 11 of the remote control key 1 instructs the UHF transmitter 12 to transmit an operation signal Ssa that includes door lock information. When the controller 21 of the vehicle 2 receives the operation signal, which includes the door lock information, with the UHF receiver 22, the controller 21 verifies the ID code of the remote control key 1 with the ID code registered in its memory 21*a* (ID verification). When the ID verification is successful, the controller 21 sends a lock instruction to the door lock device 23 and locks the doors.

When the unlock button 14 undergoes a short push operation, the communication control unit 11 of the remote control key 1 instructs the UHF transmitter 12 to transmit an operation signal Ssa that includes door unlock information. When the trunk button 15 undergoes a long push operation, the communication control unit 11 instructs the UHF transmitter 12 to transmit an operation signal Ssa that includes trunk unlock information. When the panic button 16 undergoes a long push operation, the communication control unit 11 instructs the UHF transmitter 12 to transmit an operation signal Ssa that includes panic information. The controller 21 of the vehicle 2 receives the operation signal Ssa and performs ID verification. When ID verification is successful, the controller 21 controls the door lock device 23, the trunk lock device 24, the horn 25, the hazard light 26, and the like based on the operation information included in the operation signal Ssa.

The structure of the remote control key 1 will now be described with reference to FIGS. 2 to 5.

Figure 2:
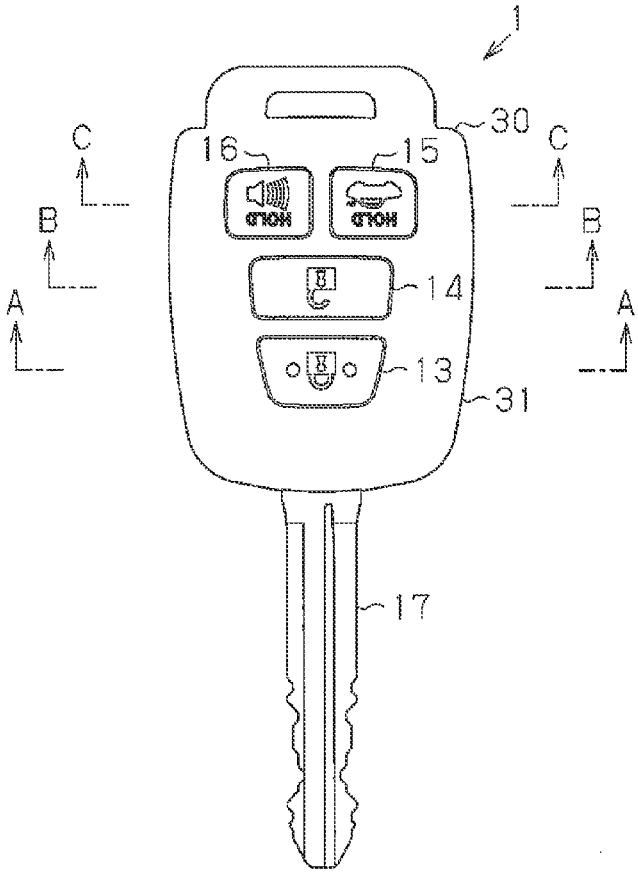
FIG. 2 is a front view showing a remote control key.

As shown in FIG. 2, the remote control key 1 includes a key plate 17 (mechanical key), which is used to mechanically unlock a door of the vehicle 2. The grip of the remote control key 1 defines an operation unit 30. The operation buttons 10, namely, the lock button 13, the unlock button 14, the trunk button 15, and the panic button 16 are arranged in the operation unit 30. The operation unit 30 includes a housing 31, which is generally box-shaped and curved. Each of the lock button 13, the unlock button 14, the trunk button 15, and the panic button 16 is an example of an operation body.

The lock button 13, the unlock button 14, the trunk button 15, and the panic button 16 each activate a corresponding switch when pushed. In the illustrated example, the lock button 13 and the unlock button 14 are arranged in order from the key plate 17. The trunk button 15 and the panic button 16 are arranged side by side. A symbol is marked on the surface of each operation button 10 to indicate the subject that is controlled when operated.

Figure 3:
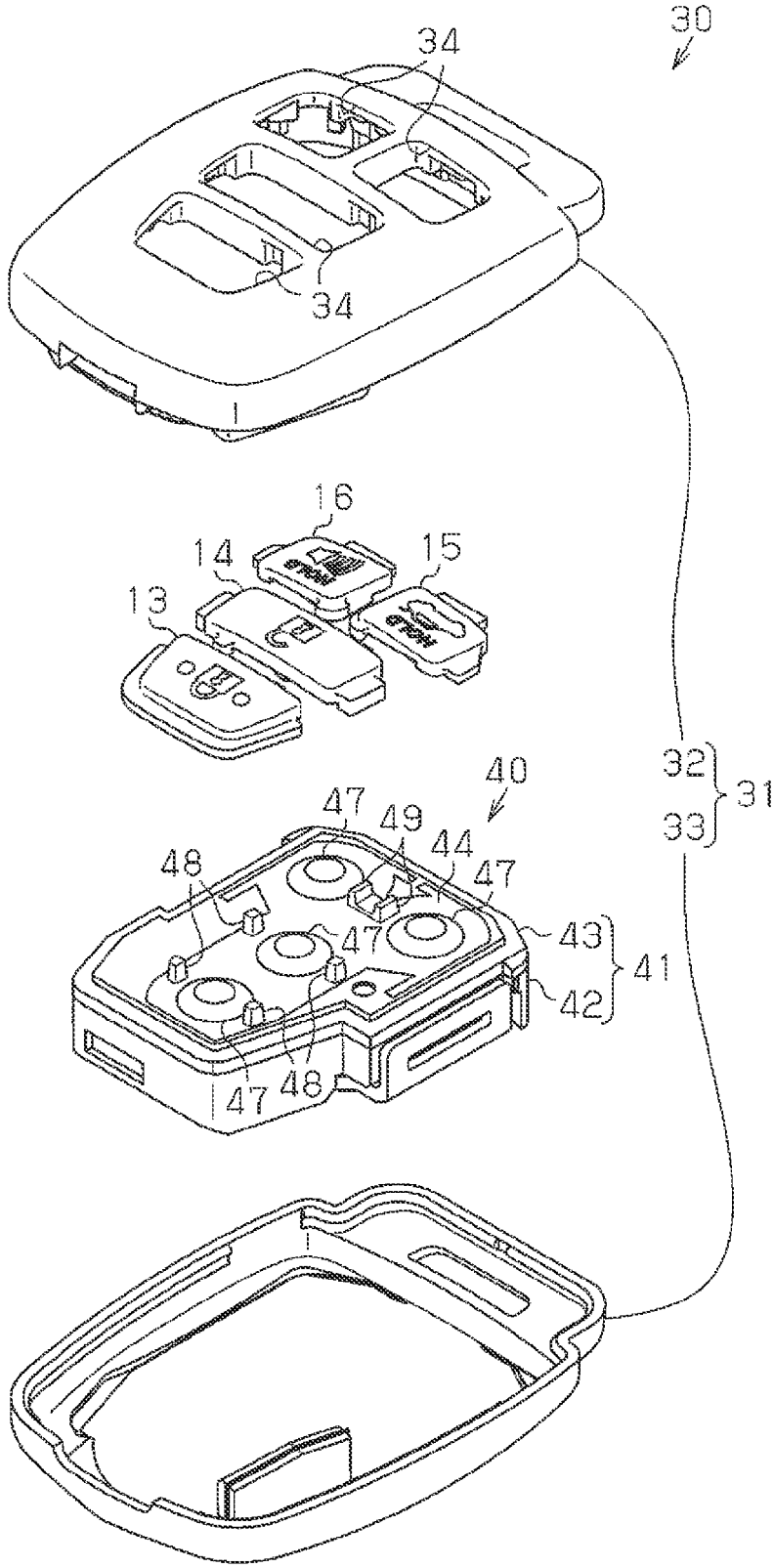
FIG. 3 is an exploded perspective view showing an operation unit of the remote control key.

As shown in FIG. 3, the housing 31 includes an upper case 32 and a lower case 33. The upper case 32 includes openings 34 that expose the outer surfaces of the lock button 13, the unlock button 14, the trunk button 15, and the panic button 16. The operation buttons 10 are arranged in the upper case 32 from the inner side. The operation buttons 10 have larger dimensions than the corresponding openings 34. This prevents separation of the operation buttons 10 from the openings 34.

The housing 31 of the operation unit 30 accommodates a transmission module 40. The transmission module 40 detects operation of the lock button 13, the unlock button 14, the trunk button 15, and the panic button 16 and transmits a corresponding operation signal Ssa. The transmission module 40 is waterproof. A battery lid (not shown) is attached in a separable manner to the rear side of the transmission module 40. In the present embodiment, a switch device is formed by an operation button 10, a support portion, which is included in the transmission module 40 and supports the operation button 10, and a detection portion, which detects operation of the operation button 10. The support portion and the detection portion will be described later.

Figure 4:
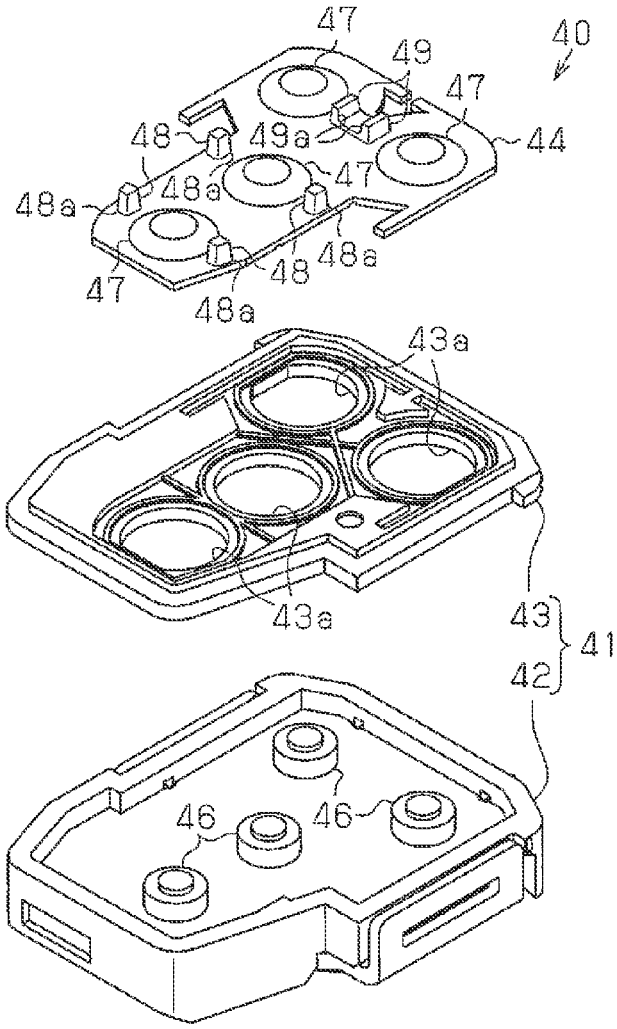
FIG. 4 is an exploded perspective view showing a transmission module.
Figure 5:
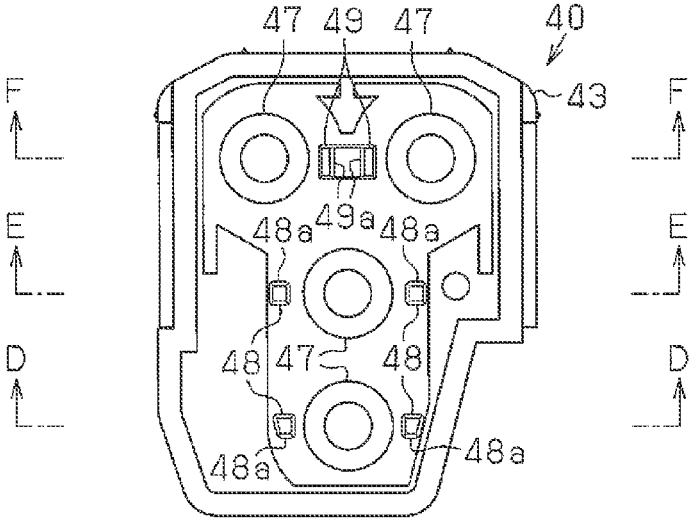
FIG. 5 is a front view showing a transmission module.

As shown in FIGS. 4 and 5, the transmission module 40 includes a retainer 41, which includes openings 43*a*, and a flat elastic member 44, which seals the openings 43*a* of the retainer 41. The retainer 41 is a container having a two-part structure with one part stacked on the other part. More specifically, the retainer 41 includes a main body 42, which has a closed bottom, and a lid 43, which is coupled to the main body 42. Electronic components are arranged in a compartment formed between the main body 42 and the lid 43. The openings 43*a* are arranged in the lid 43 at locations where the elastic member 44 is arranged. In the illustrated example, the retainer 41, which includes the main body 42 and the lid 43, are entirely formed from a hard resin. In the retainer 41, it is preferred that at least the lid 43 be formed from a hard resin.

The elastic member 44 supports the operation buttons 10. Further, the elastic member 44 elastically deforms and transmits the pushing of an operation button 10. In the illustrated example, two-color molding is performed to form the elastic member 44 and the lid 43 of the retainer 41. Two color molding is a process for combining and integrally molding different types of materials. In one example of two-color molding, a primary portion is molded in a mold, and a secondary portion is integrated with the primary portion in the same mold. The main body 42 of the retainer 41 and the lid 43 are adhered to each other by performing laser welding. Thus, the transmission module 40 has a waterproof structure, and water does not enter the transmission module 40. The lid 43 functions as an immovable member. The lid 43 is referred to as a support member.

The structure of a switch device will now be described with reference to FIGS. 6 to 9.

Figure 6A:
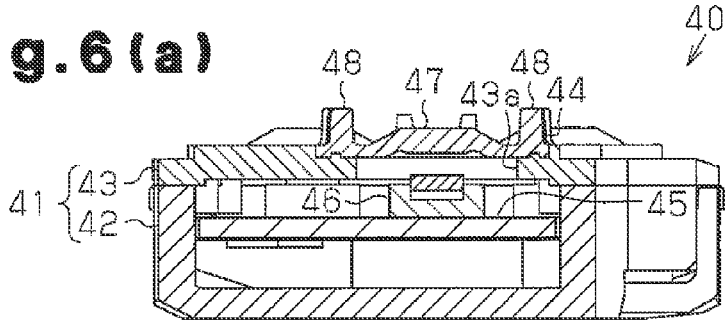
FIG. 6(*a*) is a cross-sectional view taken along line D-D in FIG. 5, and FIG. 6(*b*) is a cross-sectional view taken along line E-E in FIG. 5.
Figure 6B:
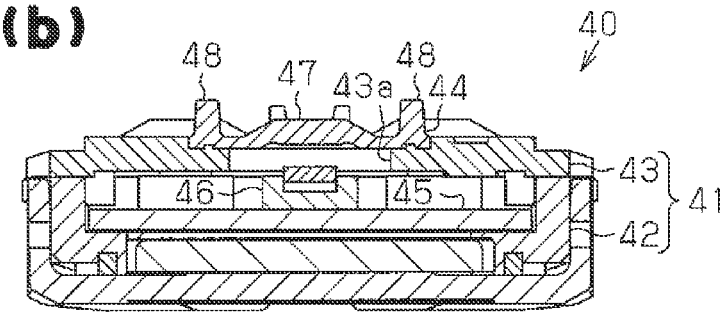

The switch devices corresponding to the lock button 13 and the unlock button 14 will first be described. As shown in FIGS. 6(*a*) and 6(*b*), a substrate 45 is arranged in the retainer 41, which is formed from a hard resin. A tactile switch 46, which serves as a switch member for detecting the pushing of the lock button 13 (unlock button 14), is arranged on the upper surface of the substrate 45. The elastic member 44 is arranged above and covers the tactile switch 46. The elastic member 44 is formed integrally with the retainer 41 to support the retainer 41.

The elastic member 44 includes a dome-shaped outwardly bulging portion 47, or diaphragm portion, which extends upward from a location aligned with each tactile switch 46. The outwardly bulging portion 47 functions as a spring that generates a reaction force when the lock button (unlock button 14) is pushed. Further, the outwardly bulging portion 47 is formed at a location corresponding to an opening 43*a* of the lid 43. A projection 48 projects upward from the upper surface of the elastic member 44 at each of the left and right sides of the outwardly bulging portion 47. The projections 48 are formed on the upper surface of the elastic member 44 at locations where the lid 43 of the retainer 41 is arranged immediately underneath. Each projection 48 includes a distal end located above a distal end of the outwardly bulging portion 47.

As shown in FIG. 4, each projection 48 is pyramidal and tapered so that its distal end is relatively thin and its basal end 48*a* is relatively thick. Thus, the thickness of the projection 48 increases in the downward direction, which is the pushing direction of the lock button 13 (unlock button 14). Further, the basal end 48*a* of the projection 48 includes a fillet that widens in the downward direction, which is the pushing direction of the lock button 13 (unlock button 14).

Figure 7A:
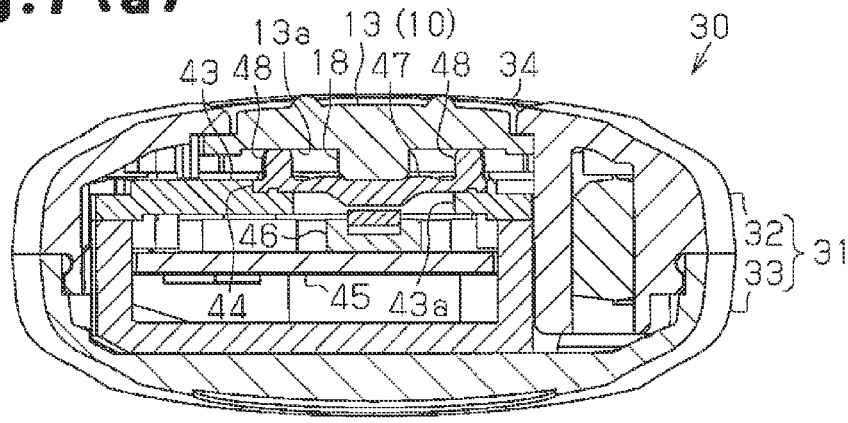
FIG. 7(*a*) is a cross-sectional view taken along line A-A in FIG. 2, and FIG. 7(*b*) is a cross-sectional view taken along line B-B in FIG. 2.
Figure 7B:
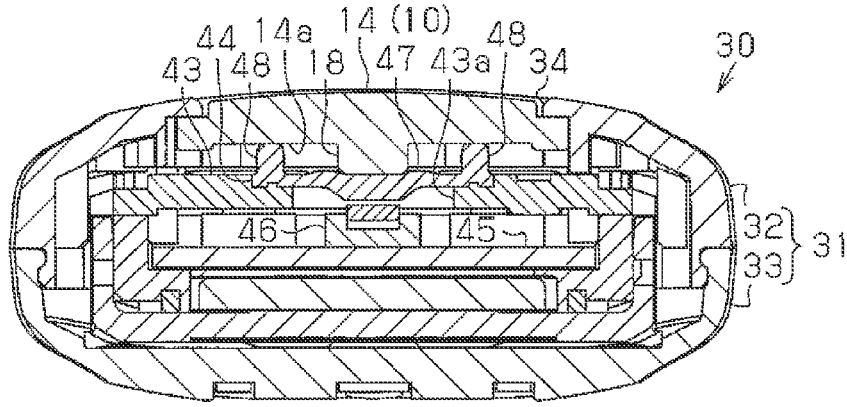
Figure 8:
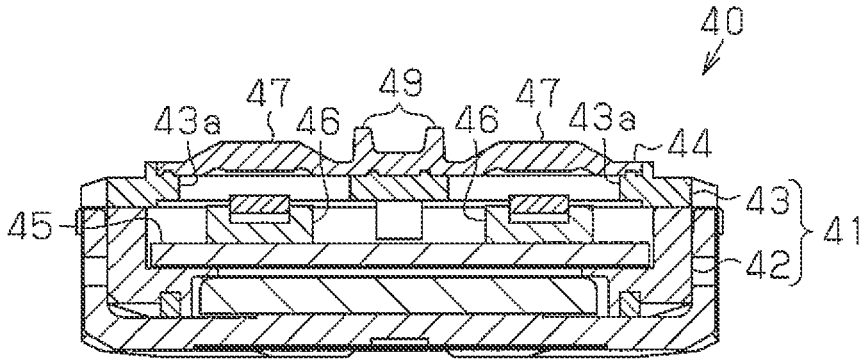
FIG. 8 is a cross-sectional view taken along line F-F in FIG. 5.

As shown in FIGS. 7(*a*) and 7(*b*), a pushing element 18, which is a cylindrical projection, is formed in the central part of the lower surface of the lock button 13 (unlock button 14). When the pushing element 18 is in contact with the outwardly bulging portion 47 of the elastic member 44, the lock button 13 (unlock button 14) is arranged in the housing 31. The lock button 13 (unlock button 14) is arranged in the corresponding opening 34 from the inner side of the upper case 32, and the transmission module 40 is held between the upper case 32 and the lower case 33. This accommodates the transmission module 40 in the housing 31. When the transmission module 40 is accommodated in the housing 31, the pushing element 18 of the lock button 13 (unlock button 14) comes into contact with the outwardly bulging portion 47 of the elastic member 44, and the projections 48 of the elastic member 44 come into contact with a lower surface 13*a* (14*a*) of the lock button 13 (unlock button 14). When the operation button 10 is not operated, the pushing element 18 of the operation button 10 pushes the outwardly bulging portion 47 of the elastic member 44 toward the tactile switch 46. In this state, the lower surface 13*a* (14*a*) of the lock button 13 (unlock button 14) compresses the projections 48 of the elastic member 44. Further, the outwardly bulging portion 47 of the elastic member 44 is not in contact with the tactile switch 46.

The switch devices corresponding to the trunk button 15 and the panic button 16 will now be described. In the same manner as the switching devices corresponding to the lock button 13 and the unlock button 14, a tactile switch 46, which detects the pushing of the trunk button 15 (panic button 16), is arranged on the upper surface of the substrate 45.

The elastic member 44 includes a dome-shaped outwardly bulging portion 47, which extends upward from a location aligned with the tactile switch 46. The outwardly bulging portion 47 functions as a spring that generates a reaction force when the trunk button 15 (panic button 16) is pushed. The outwardly bulging portion 47 may be referred to as a diaphragm portion. Projections 49 are formed on the upper surface of the elastic member 44 at locations where the lid 43 of the retainer 41 is arranged immediately underneath. One of the projections 49 is associated with the trunk button 15, and the other one of the projection 49 is associated with the panic button 16. In the illustrated example, the projections 49 are arranged between the outwardly bulging portion 47 of the trunk button 15 and the outwardly bulging portion 47 of the panic button 16. Each projection 48 includes a distal end located upward from a distal end of the corresponding outwardly bulging portion 47. Each projection 49 is formed facing toward the edge of the corresponding operation button 10 (trunk button 15 or panic button 16).

As shown in FIG. 4, each projection 49 is pyramidal and tapered so that its distal end is relatively thin and its basal end 49*a* is relatively thick. Thus, the thickness of the projection 49 increases in the downward direction, which is the pushing direction of the trunk button 15 (panic button 16). Further, the basal end 49*a* of the projection 49 includes a fillet that widens in the downward direction, which is the pushing direction of the trunk button 15 (panic button 16).

Figure 9:
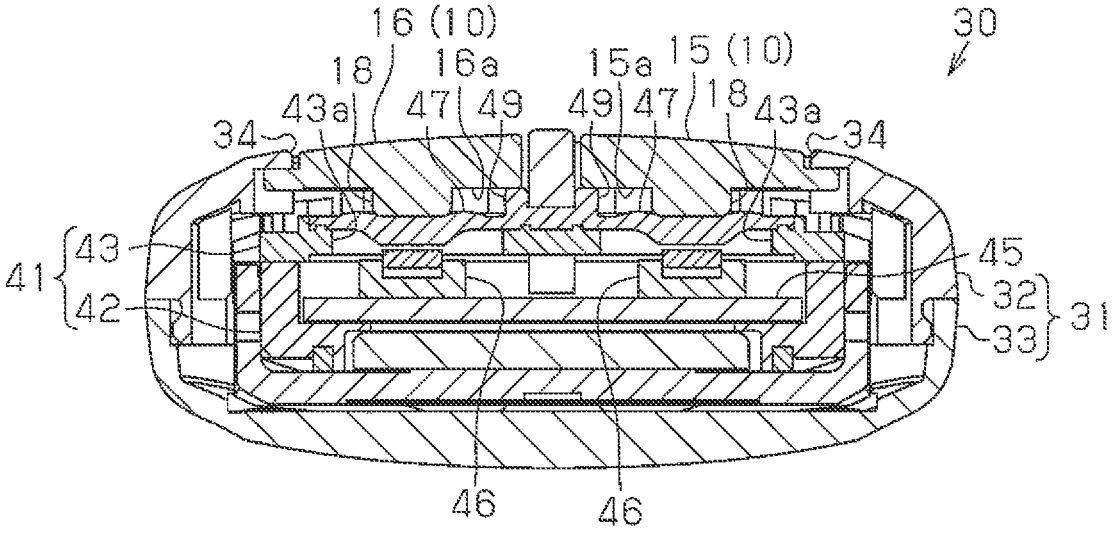
FIG. 9 is a cross-sectional view taken along line C-C in FIG. 2

As shown in FIG. 9, a pushing element 18 is formed in the central part of the lower surface of the trunk button 15 (panic button 16). In the same manner as the lock button 13 and the unlock button 14, when the transmission module 40 is accommodated in the housing 31, the pushing element 18 of the operation button 10 comes into contact with the outwardly bulging portion 47 of the elastic member 44, and the projections 49 of the elastic member 44 come into contact with a lower surface 15*a* (16*a*) of the trunk button 15 (panic button 16). When the operation button 10 is not operated, the pushing element 18 of the operation button 10 pushes the outwardly bulging portion 47 of the elastic member 44 toward the tactile switch 46. In this state, the lower surface 15*a* (16*a*) of the trunk button 15 (panic button 16) compresses the projections 49 of the elastic member 44. Further, the outwardly bulging portion 47 of the elastic member 44 is not in contact with the tactile switch 46. The trunk button 15 (panic button 16) is supported at two points by the outwardly bulging portion 47 and projection 49 of the elastic member 44. Thus, the trunk button 15 (panic button 16) is supported more stably than when supported at one point by the outwardly bulging portion 47.

When an operation button 10 of the remote control key 1 in the present embodiment is pushed, the corresponding switch device operates as described below.

Figure 10:
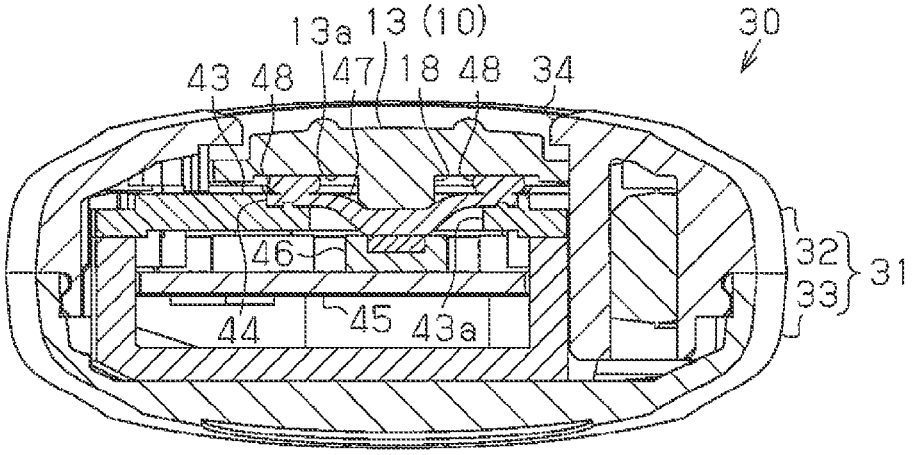
FIG. 10 is a cross-sectional view taken along line A-A in FIG. 2 when a button is pushed.

As shown in FIG. 10, the lock button 13 is supported by a plurality of the projections 48 and not supported at one point. This prevents the swaying of the lock button 13 relative to the housing 31. Since the lock button 13 does not incline and sway when the finger of the operator is placed on the lock button 13, the operation feel is improved.

Figure 11:
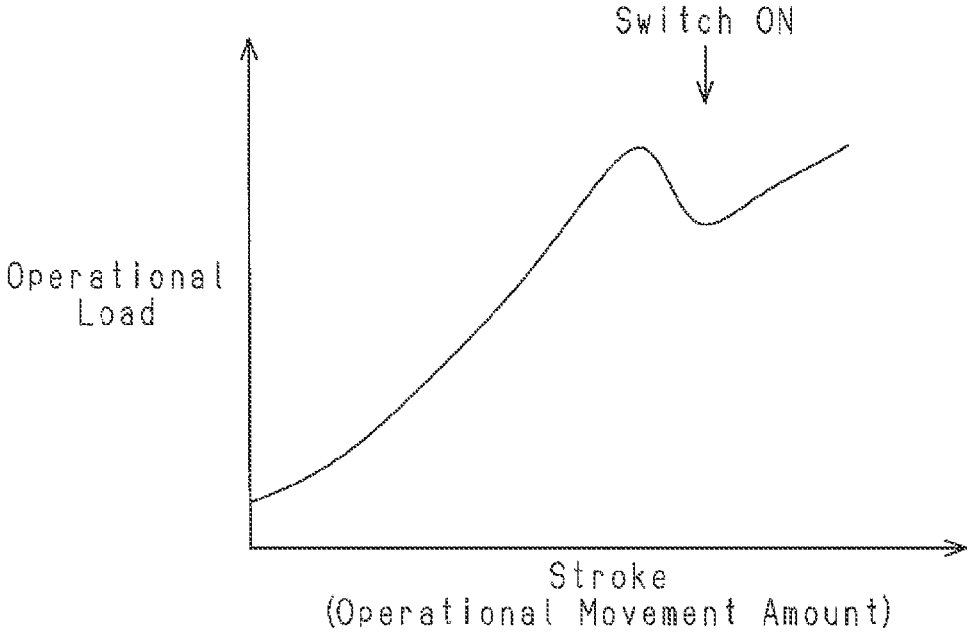
FIG. 11 is a graph showing the relationship between the operational movement amount and operational load.

When the lock button 13 is pushed, the lock button 13 moves toward the tactile switch 46. As the lock button 13 moves, the pushing element 18 elastically recesses the outwardly bulging portion 47, and the projections 48 are further compressed between the surface of the lock button 13 and the surface of the lid 43. Thus, the outwardly bulging portion 47 and projections 48 of the elastic member 44 obtain a reaction force from the initial stage of pushing. As the operation load applied to the lock button 13 increases, the lock button 13 moves accordingly. Thus, play of the lock button 13 is reduced. For example, as shown in FIG. 11, the relationship between the operational movement amount and operational load of the lock button 13 is such that the operational movement amount is generally proportional to the operational load. The increase in operational load per unit time is substantially constant from the initial stage of pushing. Since the operational load is stabilized, the operational feel of the lock button 13 is improved.

When the lock button 13 undergoes a short push operation, the tactile switch 46 is activated and a lock input signal is provided to the communication control unit 11. The communication control unit 11 transmits an operation signal Ssa, which includes door lock information, from the UHF transmitter 12. The controller 21 of the vehicle 2 receives the operation signal Ssa with the UHF receiver 22 and performs ID verification. When ID verification is successful, the controller 21 sends a lock instruction to the door lock device 23 and locks the doors.

Figure 12:
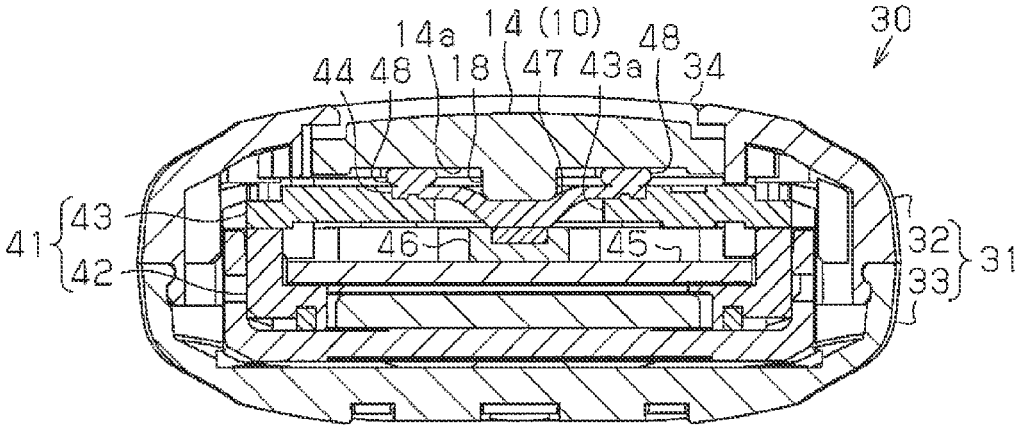
FIG. 12 is a cross-sectional view showing the operation unit along line B-B in FIG. 2 when the button is pushed.

Referring to FIG. 12, when the unlock button 14 is pushed, the unlock button 14 operates in the same manner as the lock button 13 and obtains a satisfactory operation feel. When the unlock button 14 undergoes a short push operation, the tactile switch 46 is activated and an unlock input signal is provided to the communication control unit 11. The communication control unit 11 transmits an operation signal Ssa, which includes door unlock information, from the UHF transmitter 12. The controller 21 of the vehicle 2 receives the operation signal Ssa with the UHF receiver 22 and performs ID verification. When ID verification is successful, the controller 21 sends an unlock instruction to the door lock device 23 and unlocks the doors.

Figure 13:
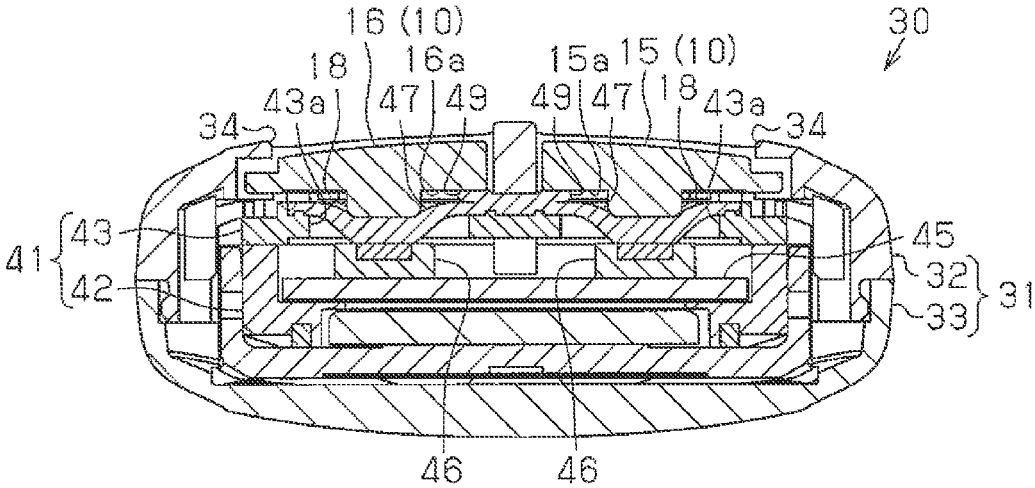
FIG. 13 is a cross-sectional view showing the operation unit along line C-C in FIG. 2 when the button is pushed.
Figure 14:
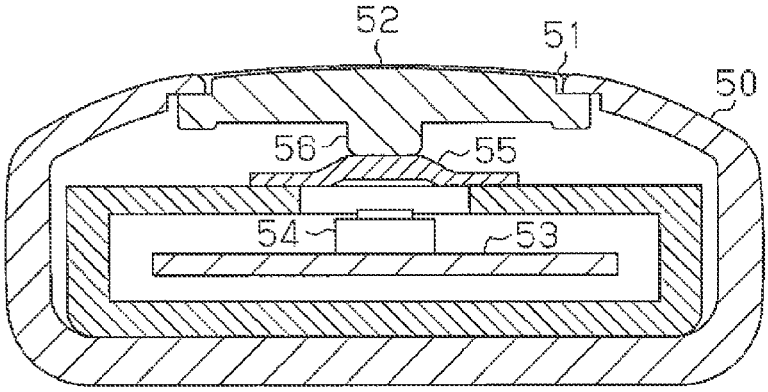
Fig.14 (Prior Art)
FIG. 14 is a cross-sectional view showing a switch device in the prior art.

Referring to FIG. 13, when the trunk button 15 (panic button 16) undergoes a short push operation, in the same manner as the lock button 13, as the trunk button 15 moves, the pushing element 18 elastically recesses the outwardly bulging portion 47, and the corresponding projection 49 is further compressed between the surface of the trunk button 15 (panic button 16) and the surface of the lid 43. Thus, the outwardly bulging portion 47 and projection 49 of the elastic member 44 obtain a reaction force from the initial stage of pushing. By increasing the operational load applied to the trunk button 15 (panic button 16) at a constant rate, the trunk button 15 (panic button 16) moves as the operational load increases. Although only one projection 49 is associated with each of the trunk button 15 and the panic button 16, for the same reasons as the lock button 13, the operation feel of the trunk button 15 and the panic button 16 is improved in comparison to when the trunk button 15 and the panic button 16 are each supported at only one point by the bulging portion 47.

When the trunk button 15 undergoes a long push operation, the tactile switch 46 is activated and a trunk lock input signal is provided to the communication control unit 11. The communication control unit 11 transmits an operation signal Ssa, which includes trunk unlock information. The controller 21 of the vehicle 2 receives the operation signal Ssa with the UHF receiver 22 and performs ID verification. When ID verification is successful, the controller 21 sends a trunk unlock instruction to the trunk lock device 24 and unlocks the trunk.

When the panic button 16 undergoes a long push operation, the tactile switch 46 is activated and a panic input signal is provided to the communication control unit 11. The communication control unit 11 transmits an operation signal Ssa, which includes panic information. The controller 21 of the vehicle 2 receives the operation signal Ssa with the UHF receiver 22 and performs ID verification. When ID verification is successful, the controller 21 sends an activation signal to the horn 25 or the hazard light 26 and blows the horn 25 or flashes the hazard light 26.

(1) Each operation button 10 is supported by the projections 48 or 49, which are formed on the elastic member 44. Thus, the operation button 10 is not supported at one point. This prevents the operation button 10 from swaying when pushed. Further, a reaction force is constantly obtained from the elastic member 44 when the operation button 10 is pushed. This improves the operation feel.

(2) When two projections 48 are formed for a single tactile switch 46, the portions supporting the operation button 10 increases. This further suppresses swaying of the corresponding operation button 10 when the operation button 10 is pushed.

(3) In a state in which an operation button 10 is not pushed, the corresponding projections 48 are in contact with the operation button 10 in a compressed state. Thus, the projections 48 produce sufficient reaction force that is applied to the operation button 10 from an initial stage when the operation button 10 is pushed. This further stabilizes the operation feel of the operation button 10.

(4) The elastic member 44 includes the outwardly bulging portions 47 that are arranged at locations aligned with the tactile switches 46. Thus, when an operation button 10 is pushed and the corresponding outwardly bulging portion 47 sinks, the operational load is absorbed. This improves the operation feel. Further, when the operation button 10 recesses the outwardly bulging portion 47, the outwardly bulging portion 47 produces an upward reaction force. Thus, the dome-shaped outwardly bulging portion 47 effectively lifts and supports the operation button 10.

(5) Each projection 49 is formed facing toward the edge of the corresponding operation button 10 (trunk button 15 or panic button 16). The projection 49 is spaced apart by a significant distance from the corresponding outwardly bulging portion 47, which contacts the central part of the trunk button 15 (panic button 16). Thus, the elastic member 44 supports the trunk button 15 (panic button 16) with further stability.

(6) When the retainer 41, which is formed from a hard resin, is supported by an elastic member 44, the elastic member 44 covers the openings 43*a* and the upper side of the tactile switches 46. This prevents operational load, which is produced by pushing an operation button 10, from being applied to the corresponding tactile switch 46 or the substrate 45. Further, the pushing load applied to the operation button 10 is absorbed by deformation of the corresponding outwardly bulging portion 47, which is a local portion of the elastic member 44. However, most of the elastic member 44 excluding the outwardly bulging portions 47 is rigidly supported by the retainer 41 (lid 43). Accordingly, the operational feel is improved, while the support of the elastic member 44 is ensured.

(7) The projections 48 and 49 are tapered and their basal ends 48*a* and 49*a* include fillets. Thus, the projections 48 and 49 do not bend when the corresponding operation button 10 is pushed. Further, the projections 48 and 49 are compressed when the corresponding operation button 10 is pushed and thereby produce a reaction force.

(8) Two-color molding is performed to integrally mold the elastic member 44 and the retainer 41 (lid 43). Thus, when the elastic member 44 is pushed, the elastic member 44 is not displaced relative to the retainer 41, and the durability is increased.

(9) The elastic member 44 is a single laminar member including diaphragm portions, which are formed at locations corresponding to the switches 46 and the openings 43*a* of the lid 43, and a non-diaphragm portion, which directly contacts the surface of the lid 43. Each of the projections 48 and 49 is formed on the upper surface of the elastic member 44 in the non-diaphragm portion, which is in contact with the surface of the lid 43. The non-diaphragm portion, on which the projections 48 and 49 are formed, directly contacts the surface of the lid 43. Thus, the projections 48 and 49 are constantly held between the surface of the lid 43 and the surface of the each operation button 10. Accordingly, the projections 48 and 49 produce a reaction force from an initial stage when the corresponding operation button 10 is pushed. In the present specification, the lower surface of the elastic member 44, which contact the upper surface of the lid 43, may be referred to as a first surface. Further, the opposite upper surface of the elastic member 44 may be referred to as a second surface.

(10) The diaphragm portions respectively correspond to the tactile switches 46. The elastic member 44 includes the projections 48, which are formed adjacent to the edges of the elastic member 44, and the projections 49, which are formed between the diaphragm portions. In this structure, each of the projections 48 and 49 is spaced apart by a significant distance from the diaphragm portion that contacts the central part of the corresponding operation button 10. In the present specification, the projections 48 formed on the elastic member 44 may be referred to as first projections, and the projections 49 formed on the elastic member 44 may be referred to as second projections.

It should be apparent to those skilled in the art that the present invention may be embodied in many other specific forms without departing from the spirit or scope of the invention. Particularly, it should be understood that the present invention may be embodied in the following forms.

In the above embodiment, the lid 43 includes the openings 43*a*, which are formed to transmit the pushing of the operation buttons 10 to switch members such as the tactile switches 46. The openings 43*a* are not limited to holes extending through the lid 43 and may be notches or channels extending inward from the periphery of the lid 43. The openings 43*a* may also be gaps or the like formed between components. In any case, it is preferable that the necessary changes be made to ensure that the structure is waterproof.

In the above embodiment, it is preferable that the immovable member (support member) be formed from a hard resin. However, the material of the immovable member (support member) is not particularly limited as long as the elastic member 44 can be supported.

In the above embodiment, the projections 49 corresponding to the trunk button 15 and the panic button 16 face toward the edges of the trunk button 15 and the panic button 16. However, the projections 49 may be located at positions where they do not face toward the trunk button 15 and the panic button 16.

In the above embodiment, each operation button 10 includes the pushing element 18. However, as long as the lower surface of the operation button 10 is in contact with the elastic member 44, the pushing element 18 can be eliminated.

In the above embodiment, the outwardly bulging portions 47 aligned with the operation buttons 10 and the tactile switches 46 do not have to be dome-shaped and may be flat. In such a case, it is preferable that the lower surfaces of the operation buttons 10 be in contact with the elastic member 44.

In the above embodiment, when coupling the operation buttons 10 to the operation unit 30, the outwardly bulging portions 47 of the elastic member 44 are recessed, and the projections 48 and 49 are compressed. In this manner, in a state in which the operation buttons 10 are not pushed, it is preferable that the outwardly bulging portions 47 and the projections 48 and 49 be elastically deformed. However, only the outwardly bulging portions 47 or only the projections 48 and 49 may be elastically deformed. Further, each of the outwardly bulging portions 47 and projections 48 and 49 may directly contact the operation buttons 10 without being deformed.

In the above embodiment, each of the lock button 13 and the unlock button 14 is associated with two projections 48. However, each of the lock button 13 and the unlock button 14 may be associated with one projection 48. Alternatively, each of the lock button 13 and the unlock button 14 may be associated with three of more projections 48.

In the above embodiment, each of the trunk button 15 and the panic button 16 is associated with one projection 49. However, each of the trunk button 15 and the panic button 16 may be associated with two or more projections 49.

In the above embodiment, the projections 48 and 49 are tapered. However, the projections 48 and 49 may each be cylindrical and have a uniform diameter as long as the strength is sufficient with respect to the pushing of the operation buttons 10.

In the above embodiment, the basal end of each of the projections 48 and 49 includes a fillet. However, the fillet can be eliminated as long as the projections 48 and 49 have sufficient strength with respect to the pushing of the operation buttons 10.

In the above embodiment, the operation buttons 10 of the remote control key 1 include the lock button 13, the unlock button 14, the trunk button 15, and the panic button 16. However, any operation button may be selected in accordance with the user's application. Further, when the vehicle 2 uses a sliding door, the operation buttons 10 may include a sliding door button that opens and closes the sliding door.

In the above embodiment, two-color molding is performed to integrally mold the retainer 41 (lid 43) and the elastic member 44. However, the elastic member 44 may be adhered to the retainer 41 (lid 43) by an adhesive agent or the like.

The radio wave frequency of the wireless key system 3 is approximately 312 MHz but may be changed to any frequency in accordance with the specification or regulations.

In the above embodiment, the radio wave frequency of the wireless key system 3 is not limited to UHF. For example, a low frequency (LF) or high frequency (HF) may be used as the radio wave frequency of the wireless key system 3.

The key plate 17 of the remote control key 1 may be eliminated.

The remote control key 1 may include an LF receiver capable of receiving radio waves in the LF band, and the vehicle 2 may include an LF receiver capable of receiving radio waves in the LF band. When determining that locking or unlocking of the doors has been completed in response to the operation signal Ssa, the controller 21 provides the LF transmitter with an instruction for transmitting a door lock/unlock completion notification signal in the LF band. In this case, the controller 21 replies to and notifies the remote control key 1 that the door locking or unlocking has been completed.

In the above embodiment, the switch devices are included in the remote control key 1 of the wireless key system 3. However, a switch device according to the present invention may be applied to various devices other than the remote control key 1 of the wireless key system 3.

Any switch may be used as long as the pushing of the switch can be detected. For example, a tactile switch or a switch including a fixed contact and movable contact such as that described in Japanese Laid-Open Patent Publication No. 2008-181791 may be used.

The present examples and embodiments are to be considered as illustrative and not restrictive, and the invention is not to be limited to the details given herein, but may be modified within the scope and equivalence of the appended claims.

The invention claimed is:

1. A switch device comprising:

an immovable member arranged between a plurality of switch members, which are arranged on a substrate, and a plurality of operation bodies, which are coupled to a housing so that each operation body can be pushed, wherein the immovable member includes a plurality of openings formed at locations respectively corresponding to the plurality of switch members;

an elastic member including a first surface, which is coupled to a surface of the immovable member, and an opposite second surface, wherein each operation body, when pushed, activates the corresponding switch member with the elastic member, and each operation body, when released from the pushed state, deactivates the corresponding switch member as a reaction force of the elastic member returns the operation body to an initial position; and a plurality of projections formed on the second surface of the elastic member at locations corresponding to the surface of the immovable member so that each of the plurality of operation bodies is supported by at least one of the plurality of projections, wherein each projection contacts the corresponding operation body in a compressed state when the corresponding operation body is not pushed.

2. The switch device according to claim 1, wherein at least two of the projections are associated with one of the switch members.

3. The switch device according to claim 1, wherein each projection, which is in the compressed state, is further elastically compressed by a surface of the corresponding operation body and the surface of the immovable member when the corresponding operation body is operated.

4. The switch device according to claim 1, wherein the elastic member includes a plurality of dome-shaped outwardly bulging portions that project toward the plurality of operation bodies and are formed at locations aligned with the plurality of switch members.

5. The switch device according to claim 1, wherein each projection of the elastic member faces toward an edge of the corresponding operation body.

6. The switch device according to claim 1, wherein the immovable member includes a support member formed from a hard resin, the openings include holes formed in the support member above the switch members, and the elastic member is arranged to cover the holes of the support member.

7. The switch device according to claim 1, wherein the elastic member is a single laminar member and includes a plurality of diaphragm portions, which are formed at locations respectively corresponding to the switch members and the openings of the immovable member, and a non-diaphragm portion, which directly contacts the surface of the immovable member, and each projection is formed on the second surface of the elastic member in the non-diaphragm portion.

8. The switch device according to claim 7, wherein the plurality of projections of the elastic member includes:

a plurality of first projections arranged adjacent to an edge of the elastic member, and a plurality of second projections arranged between the diaphragm portions.

9. A switch device comprising:

an immovable member arranged between a plurality of switch members, which are arranged on a substrate, and a plurality of operation bodies, which are coupled to a housing so that each operation body can be pushed, wherein the immovable member includes a plurality of openings formed at locations respectively corresponding to the plurality of switch members;

an elastic member including a first surface, which is coupled to a surface of the immovable member, and an opposite second surface, wherein each operation body, when pushed, activates the corresponding switch member with the elastic member, and each operation body, when released from the pushed state, deactivates the corresponding switch member as a reaction force of the elastic member returns the operation body to an initial position; and a plurality of projections forms on the second surface of the elastic member at locations corresponding to the surface of the immovable member so that each of the plurality of operation bodies is supported by at least one of the plurality of projections, wherein each projection is tapered and includes a relatively thin distal end and a relatively thick basal end, and the basal end of each projection includes a fillet that widens in a direction in which the corresponding operation body is pushed.

10. A switch device comprising:

a substrate on which a plurality of switch members are arranged;

a rigid member arranged above the substrate and including a plurality of openings and a non-opened upper surface;

an elastic member arranged directly on the rigid member to cover the plurality of openings; and a plurality of operation bodies arranged on the elastic member and respectively corresponding to the plurality of switch members, wherein the elastic member includes a plurality of elastic projections arranged so that each of the plurality of operation bodies is supported by at least one of the plurality of elastic projections directly above the non-opened upper surface of the rigid member, and wherein each elastic projection of the elastic member contacts a bottom surface of the corresponding operation body.

11. The switch device according to claim 10, wherein each elastic projection is compressed and held between a bottom surface of the corresponding operation body and the non-opened upper surface of the rigid member.

* * * * *